United States Patent [19]

Chiou

[11] Patent Number: 4,807,744

[45] Date of Patent: Feb. 28, 1989

[54] CASSETTE STATIONERY SET

[76] Inventor: Jeng-Jong Chiou, 3F-1, No. 337, Sec. 4, Hsin Yi Rd., Taipei, Taiwan

[21] Appl. No.: 169,035

[22] Filed: Mar. 16, 1988

[51] Int. Cl.[4] ..... A45C 11/34; A45C 11/36

[52] U.S. Cl. ..... 206/214; 206/223

[58] Field of Search ..... 206/214, 224, 228, 371, 206/223

[56] References Cited

U.S. PATENT DOCUMENTS

| | | | |
|---|---|---|---|
| 140,125 | 6/1873 | Ernst | 206/214 X |
| 433,536 | 8/1890 | Murdock | 206/214 |
| 4,176,743 | 12/1979 | Fitzpatrick | 206/214 |
| 4,320,835 | 3/1982 | Polhemus et al. | 206/214 X |
| 4,753,346 | 6/1988 | Tsuji | 206/371 |

FOREIGN PATENT DOCUMENTS

| | | | |
|---|---|---|---|
| 474724 | 6/1951 | Canada | 206/214 |

*Primary Examiner*—William Price

*Attorney, Agent, or Firm*—Lowe, Price, LeBlanc, Becker & Shur

[57] ABSTRACT

The present cassette stationery set is a cassette that has a notch for the location of a stapler, a scoop channel for the placement of a knife, a ring flange for the attachment of an adhesive tape, a case for containing a variety of stationery, a pen holder seat for the arrangement of a pen, and a concave plane for the insertion of a short ruler, by means of the said arrangement to form a compact stationery set for multipurpose use.

1 Claim, 2 Drawing Sheets

CASSETTE STATIONERY SET

BACKGROUND OF THE INVENTION

The present invention relates to a cassette stationery set that has a notch for the location of a stapler, a scoop channel for the placement of a knife, a ring flange for the attachment of an adhesive tape, a case for containing a variety of stationery, a pen holder seat for the arrangement of a pen, and a concave plane for the insertion of a short ruler, by means of the said arrangement to form a compact stationery set for multipurpose use.

SUMMARY OF THE INVENTION

The present invention provides a cassette stationery set, composed of a cassette, stapler, knife, adhesive tape, ball point pen, short ruler, and a cassette case, wherein the base has a notch for the location of a stapler, a scoop channel for the placement of a knife, a ring flange for the attachment of an adhesive tape, a case for containing a variety of stationery like pins, clamping pins, staples . . . etc., a pen holder seat for the arrangement of ball point pens, a concave plane for the insertion of short scales to form a variety of stationery set conceived in a cassette case.

DESCRIPTION OF THE PREFERRED EMBODIMENTS

Figure 1:
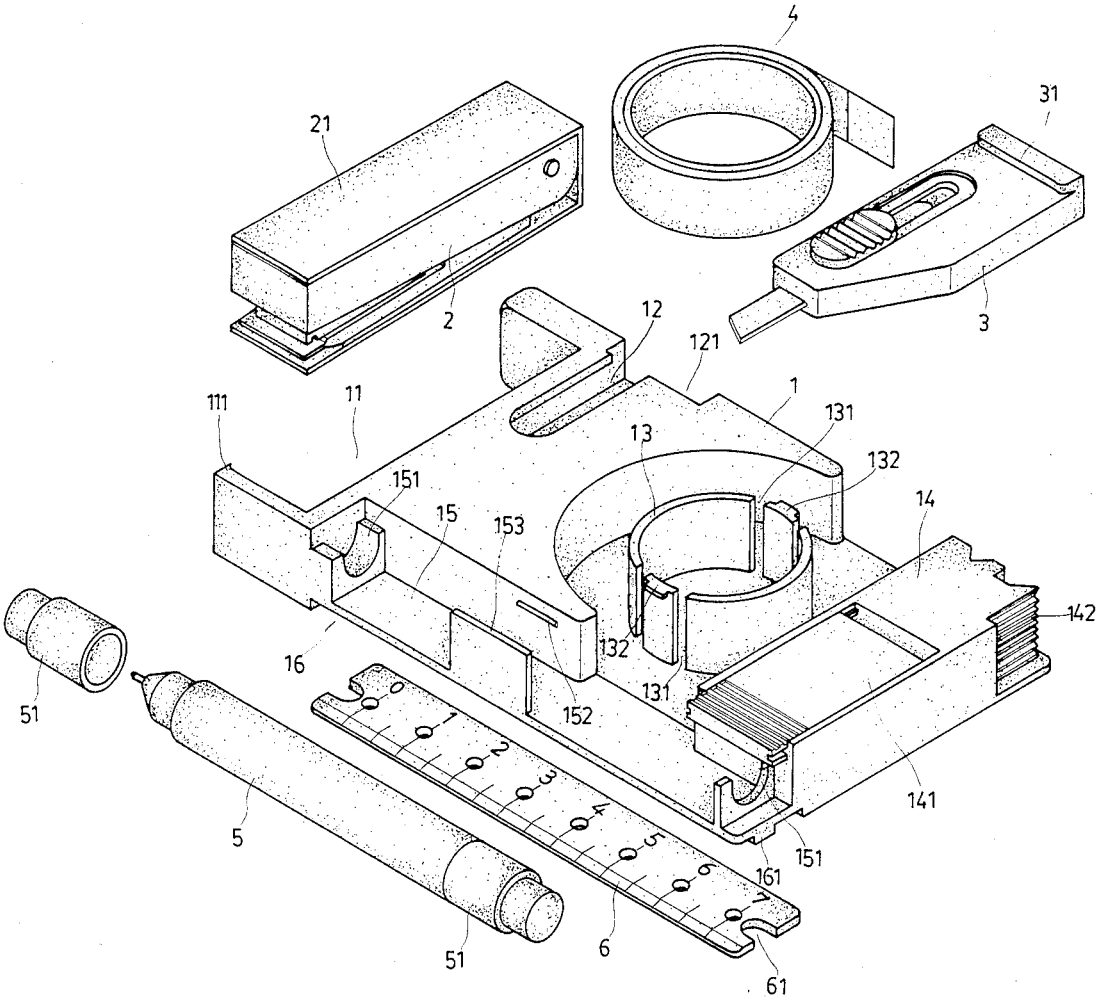
FIG. 1 is a fragmentary perspective view of a stationery cassette set embodying the present invention.
Figure 2:
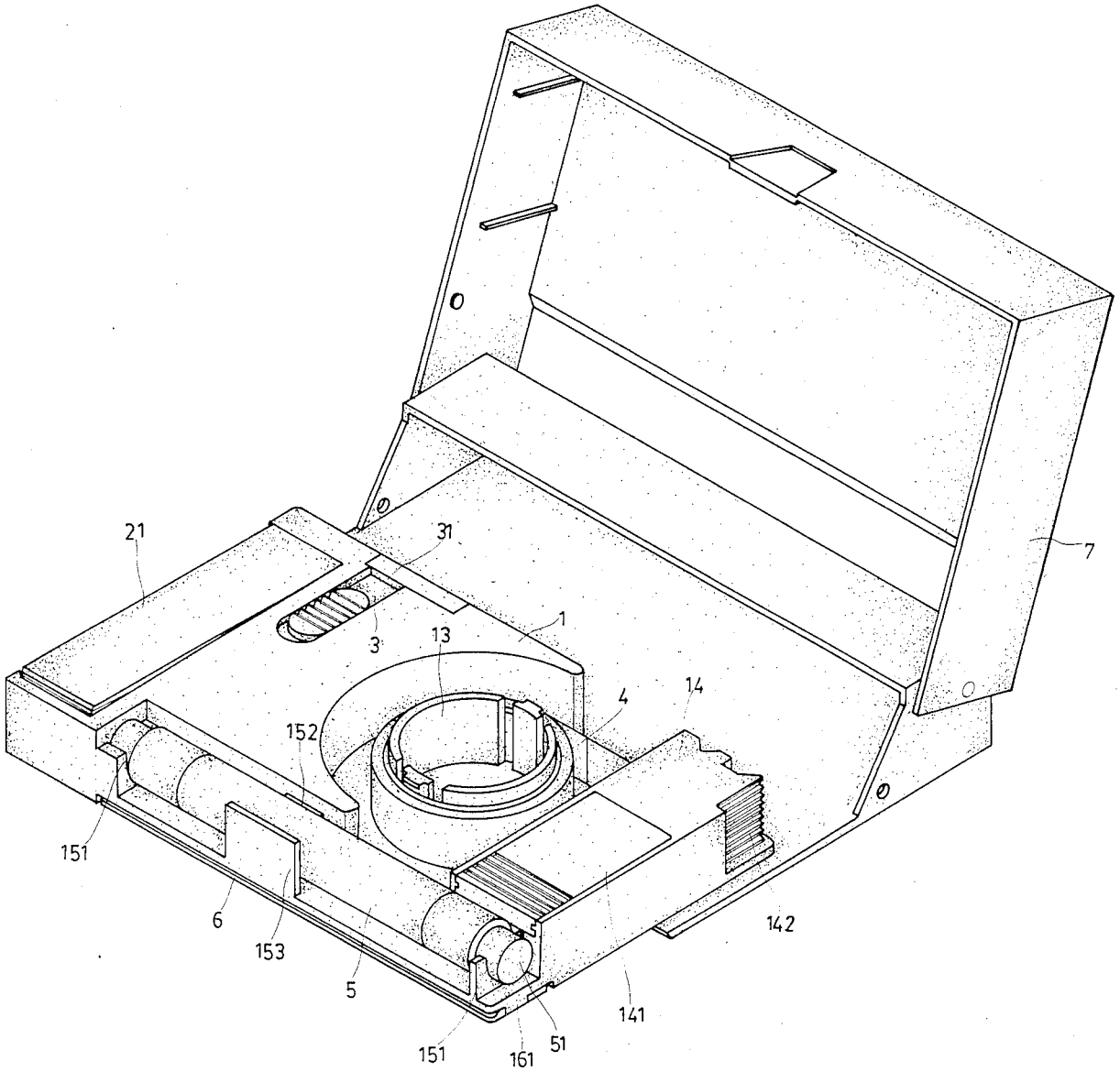
FIG. 2 is a assembly perspective view of the preferred embodiment.

As shown in FIG. 1 and FIG. 2, the present invention is composed of the assembly of base 1, stapler 2, knife 3, adhesive tape 4, ball point pen, short ruler 6 and cassette case 7. Said base comprises a notch 11 that has a flanged plate facing inward, a strip-like scoop channel 12 with a channel opening 121 at the front, a ring flange 13 that has a plurality of gaps 131 and two stop blocks 132, a case that has a cover plate 141 and one side of the case forms a cutter plane 142 for cutting the adhesive tape 4 while in application, has a pen holder seat 15 with both ends in semi-circular arc shape 151 and with a nose 152 and a stop plate 153 respectively arranged at both sides, a concave plane 16 with a flange 161 at both ends. Said stapler 2 is attached with a U-shaped clamp to match with the notch 11 of the base 1. Said knife 3 has a convex plate 31 for the placement of the knife 3 in the scoop channel 12 of the base 1. Said adhesive tape 4 can match with the ring flange 13 of the base 1 for location thereabout. Said ball point pen 5 comprises a shaft 51 respectively at both ends to match with the semi-circular arc of the base so that the ball point pen 5 can be located at the pen holder seat 15. Said short ruler 6 comprises a notch 61 respectively at both ends to match with the concave plane 16 of the base 1. Said cassette case is for receiving the base 1 and all the components set therein to become a cassette stationery set.

While assembling, place the stapler 2 in the notch 11 and by means of the flange plate 111 to restrict its movement; place the knife 3 directly into the scoop channel 2 letting the convex plane 31 match with the opening 121; slip the adhesive tape over the ring flange 13 by means of the gaps to let the stop blocks 132 be pressed inward for the placement of the adhesive tape 4 and by means of the stop blocks 132 to keep the attached adhesive tape 4 from breaking away; place the ball point pen 5 onto the pen holder seat 15 by means of the shaft 51 respectively matching with the semi-circular arc shape 151 and by means of the stop plate 153 and the nose 152 to let the located ball point pen 5 be within the confines and to keep it from breaking away; place the short ruler 6 in the concave plane 16 and be firmly located therein by means of the notch 61 and the flange 161; place the base that has all stationery set firmly placed therein in the cassette case 7 to complete the assembly.

I claim:

1. A cassete stationery set comprising:

a base, having a notch that has a flanged plate facing inward, a scoop channel opening at the front, a ring flange that has a plurality of gaps and two stop blocks, a case that has a cover plate and one side that forms a cutter plane, a pen holder seat with both ends in semi-circular arch shape and with a nose and a stop plate respectively arranged at both sides, a concave plane with a flange at both ends;

a stapler being attached with a U-shaped clamp to match with the notch of the base for location therein and by means of the flange plate to restrict its movement;

a knife being directly placed in the scoop channel a opening and having a convex plate matched with the shape of the opening;

an adhesive tape received on the ring flange of the base by means of the gap and being protected from breaking away by means of the stop blocks wherein the tape can be cut by the application of the cutter plane;

a case directly arranged at the base for receiving a variety of stationery accessaries;

a ball point pen being placed in the pen holder seat by means of its shaft at both ends to respectively match with the semi-circular arc and being firmly located therein by means of the restriction of the stop plate and the nose;

a short rule being placed in the concave plane and firmly located therein by means of notches on the scale respectively matching with the flanges of the concave plane;

a cassette case for receiving the base and all the stationery components placed in the base.

* * * * *